US006419509B2

(12) United States Patent
Cho

(10) Patent No.: US 6,419,509 B2
(45) Date of Patent: Jul. 16, 2002

(54) MEMORY CARD CONNECTOR WITH IMPROVED CARD INSERTION/EJECTION OPERATION

(75) Inventor: Han Seon Cho, Suwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/863,371

(22) Filed: May 24, 2001

(30) Foreign Application Priority Data

May 24, 2000 (KR) ..... 00/28165

(51) Int. Cl.[7] ..... H01R 13/62
(52) U.S. Cl. ..... 439/159
(58) Field of Search ..... 439/159, 152, 439/153, 154, 155, 160

(56) References Cited

U.S. PATENT DOCUMENTS 5,149,276 A * 9/1992 Dixon ..... 439/159
5,286,214 A * 2/1994 Takahashi ..... 439/159
5,836,775 A * 11/1998 Hiyama et al. ..... 439/159

* cited by examiner

*Primary Examiner*—Tho D. Ta
(74) *Attorney, Agent, or Firm*—Birch, Stewart, Kolasch & Birch, LLP

(57) ABSTRACT

In a memory card connector for an information apparatus, a memory card can be prevented from being damaged in its inserting and ejecting operation by performing the inserting and ejecting operation of the memory card stably as a linear motion. A memory connector for an information apparatus includes two frames separately having a memory card insertion portion, a plurality of connector terminals installed at a certain side of each frame and connected to a memory card, a card tray for mounting the memory card and moving back and forth inside each frame, and an eject lever receiving a driving force for ejecting the memory card from outside, an eject spring elastically deformed by the eject lever and having a bridging hole at a side thereof, and a protruding member formed on a side of the card tray in order to fix the card tray at the memory card insertion portion of the frame by engaging with the hole of the eject spring.

10 Claims, 4 Drawing Sheets

MEMORY CARD CONNECTOR WITH IMPROVED CARD INSERTION/EJECTION OPERATION

BACKGROUND OF THE INVENTION

1. Field of the Invention

The present invention relates to a memory card connector for an information apparatus, and in particular to a memory card connector for an information apparatus which is capable of preventing a memory card from being damaged in injecting and ejecting operation and preventing a memory card from projecting abruptly from a connector by including a memory card tray.

2. Description of the Prior Art

As depicted in FIG. 1, in a memory card connector for an information apparatus in accordance with the prior art, a memory card insertion portion 2 is formed inside a frame 1, and a plurality of connector terminals 3 for transmitting signals to a terminal CT of a memory card C are installed at the inner surface of the memory card insertion portion 2.

The plurality of connector terminals 3 are extended-installed from the rear of the memory card insertion portion 2 opposite to the front of the frame 1 where the memory card C is inserted.

In the meantime, as depicted in FIG. 2, a substrate contact portion 3' is curved-formed so as to be parallel to a surface of a substrate B in order to connect circuits and elements of the substrate B being mounted the frame 1 on.

The substrate contact portion 3' connects signals between the substrate B and an connector by contacting to the upper surface of the substrate B.

And, an eject lever 5 is installed at the inner side of the frame 1 in a length direction of the frame 1.

An interlocking unit 5' is curved-formed at the outer end of the eject lever 5 in order to interlock with an eject knob (not shown) installed at the exterior of the information apparatus and is operated by a user.

In the meantime, an operating lever 7 is installed at the rear of the frame 1 so as to horizontally cross the installation portion of the plurality of connector terminals.

The operating lever 7 pushes the memory card C inserted into the memory card insertion portion 2 outside of the connector by rotating at a certain angle centering around a rotation center pin 1P formed in the frame 1.

And, the operating lever 7 is operated by the eject lever 5, an interlocking groove 7' is formed at the side of the operating lever 7, an interlocking protrusion 6 for interlocking with the operating lever 7 is formed in the interlocking groove 7' so as to contact to the eject lever 5.

And, an assembly hole 8 for assembling the rotation center pin 1P and a combination hole 8' which can be a rotation center of the operating lever 7 by combining with the rotation center pin 1P are formed inside the operating lever 7 and interlocking groove 7'.

Herein, the assembly hole 8 is formed greater than a diameter of the rotation center pin 1P, and the combination hole 8' is formed same as or a little bit greater than the diameter of the rotation center pin 1P.

In addition, as depicted in FIG. 1, a push unit 9 is formed at the opposite side of the rotation center pin 1P so as to contact to the end portion of the memory card C in order to push the memory card C outwardly.

As depicted in FIG. 2, the memory card connector in accordance with the prior art is installed on the substrate B.

In other words, the frame 1 is installed onto the substrate B, and the substrate contact portion 3' of the plurality of connector terminals 3 is surface-welded so as to contact to the substrate B.

On that basis, when the memory card C is inserted into the memory card insertion portion 2 of the frame I from the exterior of the information apparatus by the user, the plurality of terminals CT of the memory card C can be contacted to the plurality of connector terminals 3, accordingly signals can be contacted between the memory card C and information apparatus. (i.e., in more detail, signals can be contacted between the memory card C and the substrate B.)

When the memory card C is inserted into the frame 1, the push unit 9 of the operating lever 7 is tightly contacted to the rear end of the memory card C.

Hereinafter, the operation for ejecting the memory card C from the information apparatus will now be described.

When the user pushes the eject lever 5 in an arrow direction as shown in FIG. 1, the interlocking protrusion 6 and the interlocking groove 7' are interlocked by the movement of the eject lever 5, the operating lever 7 rotates in a counter-clockwise direction centering around the rotation center pin 1P as shown in FIG. 1, accordingly the push unit 9 of the operating lever 7 outwardly pushes the memory card C.

As described above, when the memory card C outwardly projects a little by the operation of the eject lever 5, the user can grasp the memory card C and can eject the memory card C from the information apparatus.

However, the memory card connector for the information apparatus in accordance with the prior art has below problems.

First, because the push unit 9 is constructed so as to push not both rear ends of the memory card C but the one rear end of the memory card C, although the operating lever 7 pushes the memory card C by rotating, the all push power can not be used for pushing the memory card C outwardly but part of the push power is used for a rotation moment of the memory card C.

Accordingly, the ejecting operation of the memory card C can not be performed smoothly, and at the same time the memory card may be easily damaged by rubbing with the side wall of the frame 1 due to the rotation moment.

In addition, when the ejecting operation is not performed smoothly, the user has to insert the memory card C again inside the memory card insertion portion C in order to eject the memory card C by operating the eject lever 5.

In the meantime, in order to solve above-mentioned problems, a stroke of the eject lever 5 has to increase in order to push the memory card C more securely, as well as the size of the memory card connector has to increase in accordance with the increase of the stroke of the eject lever 5, accordingly it is inappropriate because of an area increase problem on the substrate B.

And, in the ejecting operation of the memory card C, when the memory card C is ejected from the frame 1, because there is no unit for holding the memory card C, the memory card C may be totally separated from the information apparatus and may be damaged due to a collision with a floor.

SUMMARY OF THE INVENTION

Accordingly, it is an object of the present invention to provide a memory card connector for an information apparatus which is capable of performing the inserting/ejecting operation of a memory card into/from a memory card connector as a linear motion.

It is another object of the present invention to provide a memory card connector for an information apparatus which is capable of performing the inserting/ejecting operation of a memory card more securely.

In order to achieve the objects of the present invention, there is a memory card connector for an information apparatus in accordance with the present invention including two frames separately having a memory card insertion portion, a plurality of connector terminals installed at a certain side of the each frame and connected to a memory card, a card tray for being mounted the memory card and moving back and forth inside the each frame, and an inserting and ejecting means for installing the card tray inside the frame and moving the card tray outwardly.

DETAILED DESCRIPTION OF THE PREFERRED EMBODIMENT

Hereinafter, the preferred embodiment of a memory card connector for an information apparatus in accordance with the present invention will now be described in detail with reference to accompanying drawings.

Figure 1:
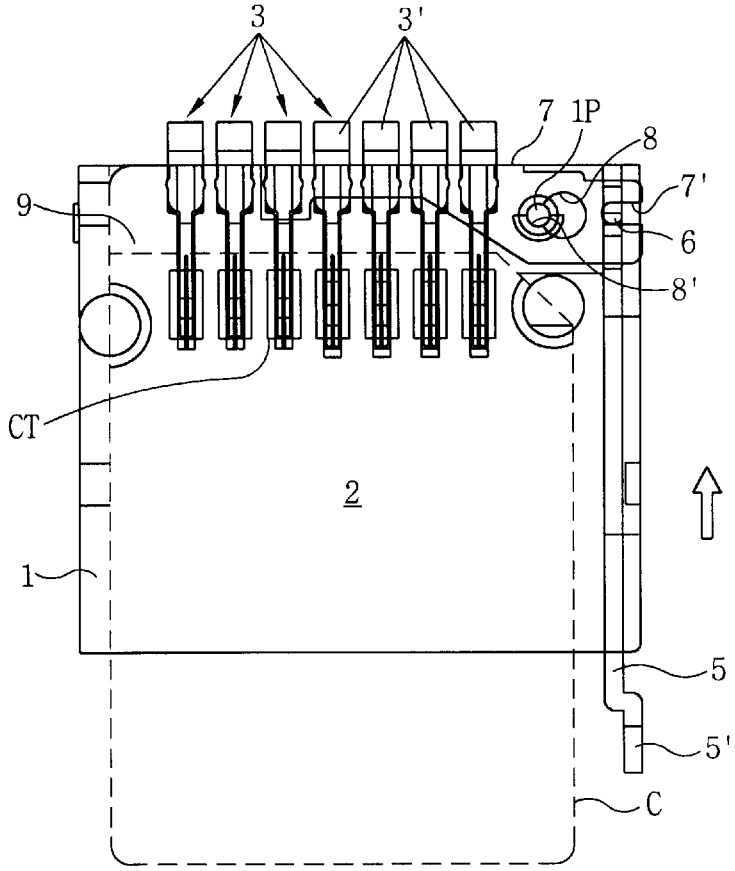
FIG. 1 CONVENTIONAL ART
FIG. 1 is a plan view illustrating a memory card connector for an information apparatus in accordance with the prior art.
Figure 2:
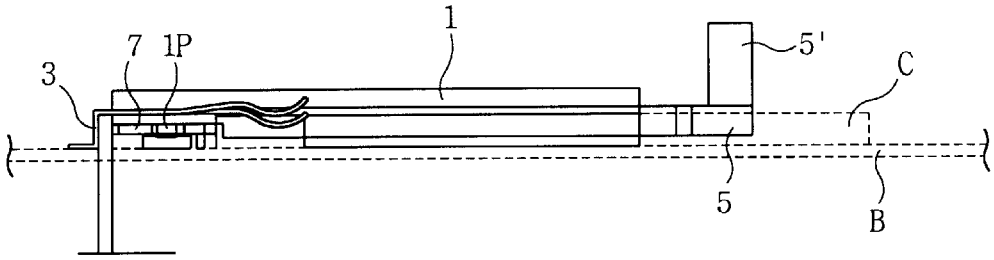
FIG. 2 CONVENTIONAL ART
FIG. 2 is a side sectional view illustrating the memory card connector for the information apparatus in accordance with the prior art installed onto a substrate of an information apparatus.
Figure 3:
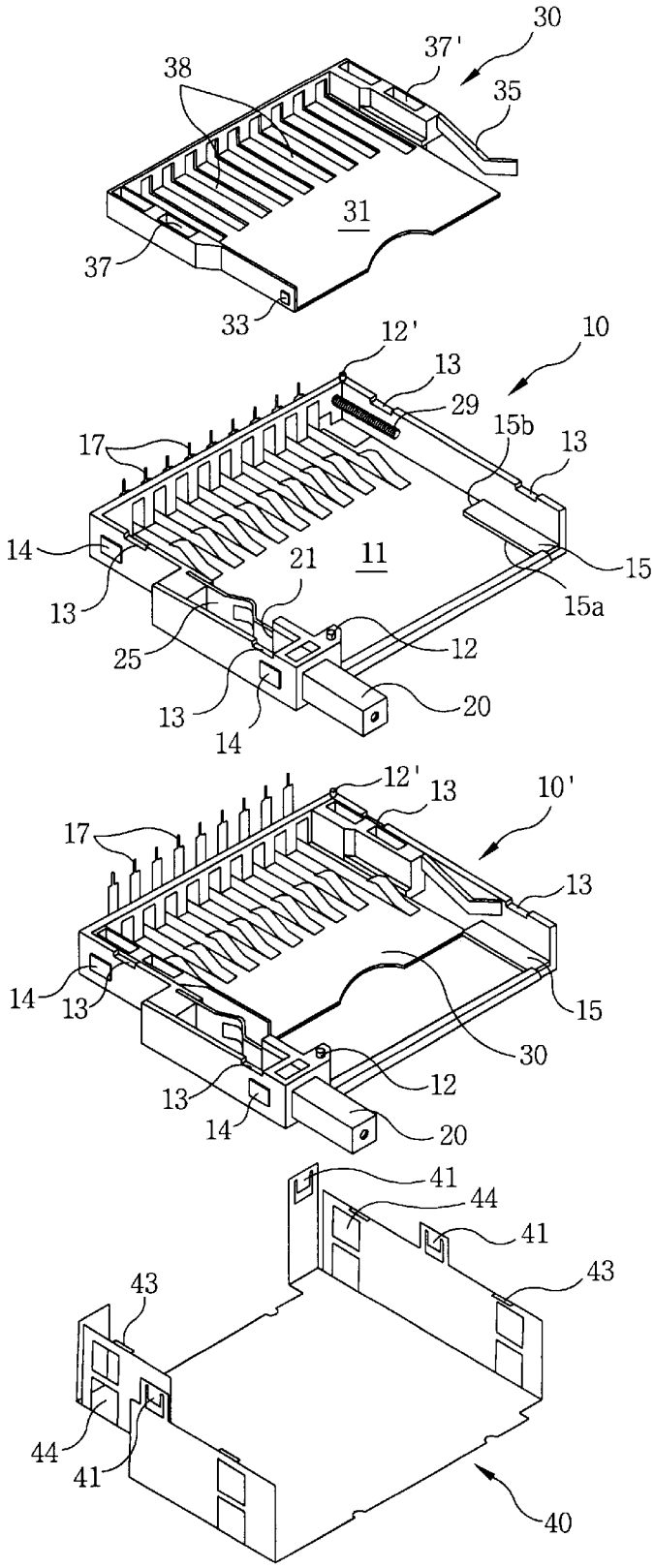
FIG. 3 is a perspective view illustrating a disassembled memory card connector for an information apparatus in accordance with the present invention.
Figure 4:
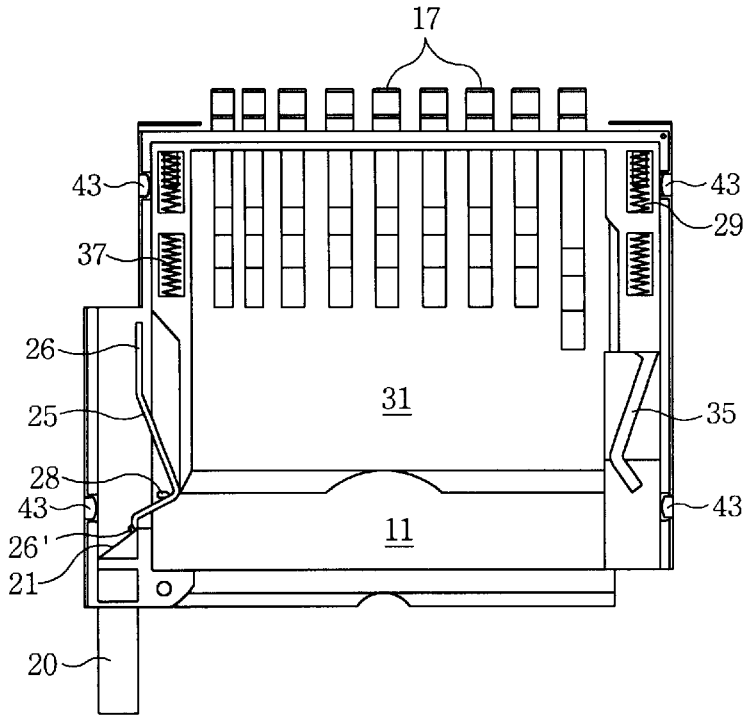
FIG. 4 is a plan view illustrating the memory card connector for the information apparatus in accordance with the present invention.
Figure 5:
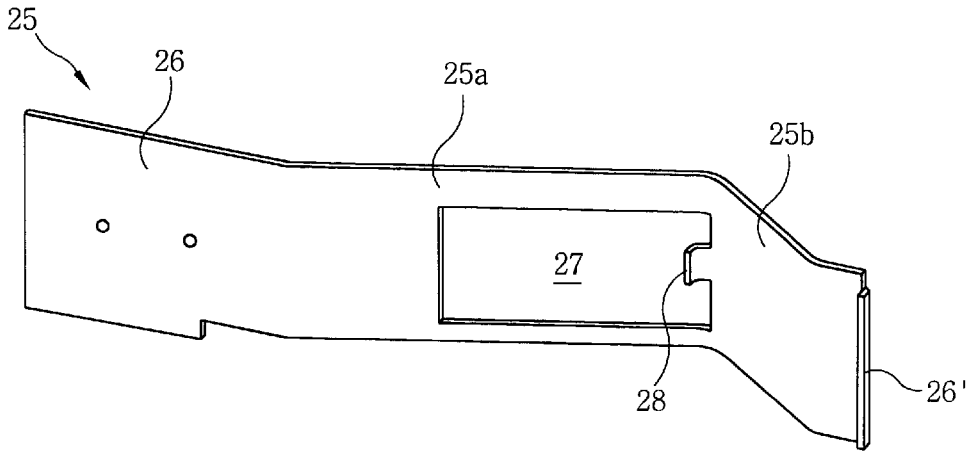
FIG. 5 is a perspective view illustrating an eject spring of the memory card connector for the information apparatus in accordance with the present invention.

As depicted in FIGS. 3–5, each frame 10, 10' including a memory card insertion portion 11 is orderly laminated.

Guide protrusions 12, 12' guiding the lamination of the each frame 10, 10' are formed at the side ends of the each frame 10, 10'.

And, insertion grooves (not shown) are formed on the bottom surface of the each frame 10, 10' so as to correspond to the guide protrusions 12, 12'.

The frames 10, 10' have the same shape, and it is possible to laminate a plurality of the frames consecutively in another embodiment of the present invention.

And, at least one fixation groove 13 is formed on the upper surface of the each frame 10, 10' in order to combine the frames 10, 10'.

It is advisable to form four fixation grooves 13 on the upper surface of the each frame 10, 10'.

In addition, a plurality of bridging protrusions 14 are formed on the outer side surface of the each frame 10, 10' in order to combine a housing 40 to the each frame 10, 10' more securely by corresponding to a plurality of bridging holes 44 of the housing 40.

And, a regulation unit 15 is formed at the upper side surface of the memory card insertion portion 11 of the each frame 10, 10'.

The regulation unit 15 guides movement of a card tray 30 and regulates the movement at the same time.

In other words, a guide surface 15*a* parallel to the side wall of the each frame 10, 10' guides transferring of the card tray 30, and a regulate surface 15*b* vertical to the side wall of the each frame 10, 10' regulates the transferring (ejection degree) of the card tray 30.

In addition, a plurality of connector terminals 17 are installed from the interior of the memory card insertion portion 11 to the exterior of the each frame 10, 10'.

The plurality of connector terminals 17 connect electrically a memory card to a main substrate (not shown) of the information apparatus.

The plurality of connector terminals 17 of the frame 10 to be placed at the upper portion are formed so as to be shorter than the plurality of connector terminals 17 of the frame 10' to be placed at the lower portion in order to install together the plurality of connector terminals 17 of the laminated frames 10, 10' on a main substrate.

In more detail, by forming the plurality of connector terminals of the frame 10 relatively adjacent to the main substrate so as to be shorter and forming the plurality of connector terminals of the frame 10' relatively distant from the main substrate so as to be longer, the plurality of connector terminals 17 of the each laminated frame 10, 10' can be installed on the main substrate equally.

The plurality of connector terminals 17 of the frame 10 are formed so as to contact with the plurality of connector terminals 17 of the frame 10' by the same functions.

In the meantime, a card tray 30 is fixed inside the memory card insertion portion 11 of the each frame 10, 10', and an eject lever 20 is installed at a certain side of the each frame 10, 10'.

The eject lever 20 is for ejecting the memory card from the information apparatus by interlocking with an eject knob (not shown) exposed at the exterior of the information apparatus.

An incline surface 21 is formed at the rear end of the eject lever 20.

And, as depicted in FIG. 5, an eject spring 25 is formed inside the each frame 10, 10'. The eject spring 25 is a kind of plate spring, the eject spring 25 has a first curved portion 25*a* formed from a fixation portion 26 fixed to a certain side of is the each frame 10, 10' and a second curved portion 25*b* connected to the first curved portion 25*a*.

Herein, an interlocking flap 26' contacting to the incline surface 21 is formed at the end of the second curved portion 25*b* of the ejecting spring 25.

In addition, a bridging hole 27 and a bridging flap 28 for fixing the card tray 30 are formed at the first curved portion 25*a* of the eject spring 25.

The bridging flap 28 is curved-formed at the side of the bridging hole 27 in order to support a bridging protrusion 33.

In the meantime, a spring 29 is installed at the both inner sides of the each frame 10,10' and provides the elasticity for ejecting the card tray 30 outwardly.

The memory card C is mounted on the card tray 30, the card tray 30 is installed so as to be movable back and forth inside the memory card insertion portion 11 of the each frame 10, 10'.

And, a mounting surface 31 is formed on the upper surface of the card tray 30, and the bridging protrusion 33 is formed at the side end of the card tray 30 so as to correspond to the bridging hole 27 of the eject spring 25.

The bridging protrusion 33 fixes the card tray 30 inside the memory card insertion portion 11 by combining with the bridging hole 27.

And, an elastic lever 35 having an elasticity is formed at a certain side opposite to the bridging protrusion 27, the elastic lever 35 pushes the memory card with the elasticity, accordingly the memory card 30 can be fixed inside the card tray 30 more securely.

The elastic lever 35 is formed first so as to become narrow inwardly and later become wider outwardly in a front direction of the card tray 30.

And, spring guides 37, 37' are formed at the both sides of the card tray 30, the springs 29 are placed inside the spring guides 37, 37'.

Most length of the spring 29 is placed inside the spring guides 37, 37', respectively.

And, a plurality of terminal slots 38 for the plurality of connector terminals 17 placed in the memory card insertion portion 11 are formed on the mounting surface 31 of the card tray 30.

The plurality of connector terminals 17 are exposed to the upper surface of the card tray 30 through the plurality of terminals slots 38 and contact to the memory card mounted on the mounting surface 31.

The housing 40 is formed by curving a metal plate in order to combine the each frame 10, 10'.

And, a plurality of fixation flaps 43 are formed so as to correspond to the plurality of fixation grooves 13 of the frame 10 in order to combine the housing 40 with the frames 10, 10'.

In addition, a plurality of bridging holes 44 are punched through the side surface of the housing 40 so as to correspond to the plurality of bridging protrusions 14 of the each frame 10, 10', by inserting the plurality of bridging protrusions 14 into the plurality of bridging holes 44, the each frame 10, 10' and housing 40 can combine more securely and accurately.

The operation of the memory card connector for the information apparatus will now be described in detail.

First, the each frame 10, 10' is orderly laminated by using the guide protrusions 12, 12', and the laminated frames 10, 10' are installed on the housing 40.

Herein, the plurality of fixation flaps 43 are curved so as to correspond to the plurality of fixation grooves 13 of the frame, the plurality of bridging protrusions 14 are inserted into the plurality of bridging holes 44 of the housing 40, accordingly the housing 40 and the frames 10, 10' are combined and fixed.

Accordingly, the plurality of connector terminals 17 which are installed at the each frame 10, 10' are gathered and piled up.

And, the frames 10, 10' fixed to the housing 40 are installed on the main substrate. Herein, the plurality of connector terminals 17 are inserted into a hole of the main substrate and performs electric connection between circuits and elements of the main substrate.

Hereinafter, the inserting and ejecting operation of the memory card into or from the memory card connector for the information apparatus in accordance with the present invention will now be described.

Figure 6:
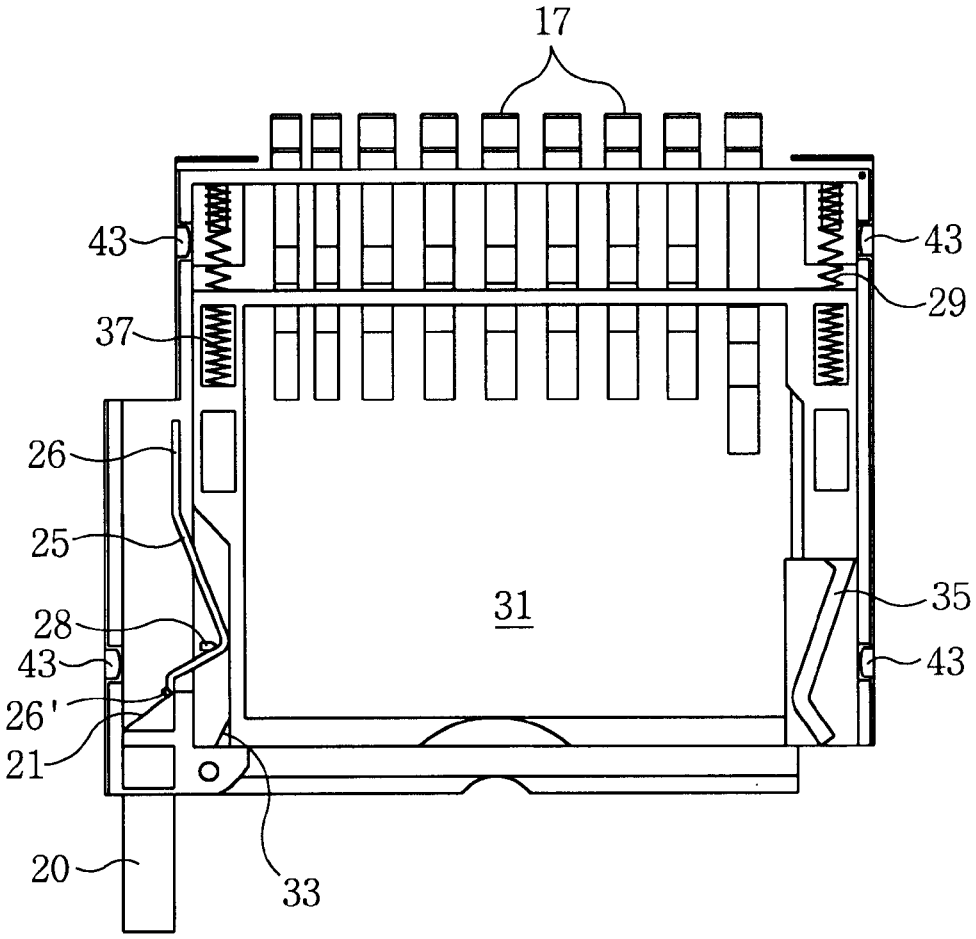
FIG. 6 is a plan view illustrating the memory card connector for the information apparatus in accordance with the present invention.

FIG. 6 is a front view illustrating the memory card connector for the information apparatus in an insertion standby state, the front end of the card tray 30 is pulled out from the memory card insertion portion 11 of the each frame 10, 10'.

Herein, as depicted in FIG. 6, in pulling the card tray 30 out, the rear end of the elastic lever 35 connected to the card tray 30 is regulated by the regulation surface 15*b* as shown in FIG. 3.

Accordingly, although the elasticity of the spring 29 works, the card tray 30 does not project outwardly.

In addition, the both side surfaces of the card tray 30 are supported by the both inner side walls and the guide surface 15*a* of the each frame 10, 10'.

When the memory card is mounted on the mounting surface 31 of the card tray 30 of the each frame 10, 10' and the user inserts the card tray 30 inside the each frame 10, 10', the card tray 30 is inserted into the memory card insertion portion 11 of the each frame 10, 10' by overcoming the elasticity of the spring 29.

Herein, because the bridging protrusion 33 of the card tray 30 presses the eject spring 25 while moving along the second curved portion 25*b* as shown in FIG. 5, the eject spring 25 is elastic-deformed.

Herein, the bridging protrusion 33 is continually contacted to the second curved portion 25*b*.

As described above, when the inserting operation of the card tray 30 is continued, the bridging protrusion 33 is contacted to the first curved portion 25*a* passing through the second curved portion 25*b*, and is inserted into the bridging hole 27 of the eject spring 25 as depicted in FIG. 5.

FIG. 6 is a plan view illustrating the card tray 30 inserted into the frame 10, the side of the bridging protrusion 33 is supported by the bridging flap 28.

And, the eject spring 25 in the elasticity restoration state acts its elasticity to the card tray 30.

In the meantime, the memory card inserted inside the card tray 30 is fixed by being pressed by the elasticity of the elastic lever 35 and is electrically connected to the plurality of connector terminals 17 projected from the card tray 30 through the plurality of terminal slots 38.

The inserting operation of the memory card is described as above, the ejecting operation of the memory card from the frame will now be described.

When the eject lever 20 is pressed by the user, the interlocking flap 26' is pressed by the incline surface 21 of the eject lever 20, accordingly the eject spring 25 is elastic-deformed.

Herein, the elasticity deformation of the eject spring 25 works on the first curved portion 25*a* of the eject spring 25 so as to be separated from the card tray 30, accordingly the bridging protrusion 33 of the card tray 30 is released from the bridging hole 27.

Accordingly, the card tray 30 is transferred outside of the memory card insertion portion 11 by a restoring force of the spring 29.

Herein, the card tray 30 is guided by the both inner side walls and the guide surface 15*a* of the each frame 10, 10'.

Accordingly, the memory card mounted on the card tray 30 can be transferred outside of the each frame 10, 10' and can be exposed to outside.

Herein, because the memory card is fixed inside the card tray 30 by the elastic lever 35, the memory card is not separated from the each frame 10, 10'.

Herein, the user ejects the memory card from the card tray 30 with a power greater than the elasticity of the elastic lever 35.

As described above, the memory card connector for the information apparatus in accordance with the present invention can prevent a memory card from being damaged in the inserting and ejecting operation and can provide an accurate transferring track by including a card tray.

And, the memory card connector for the information apparatus in accordance with the present invention can prevent a memory card from projecting abruptly outside of a memory card connector in the ejecting process by fixing the memory card inside a card tray.

Accordingly, the memory card connector for the information apparatus in accordance with the present invention can prevent the memory card from being damaged by preventing an abrupt projection in advance.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

What is claimed is:

1. A connector for a memory card, comprising:

a frame having a memory card insertion portion;

a plurality of connector terminals installed at a certain side of the frame for being connected to a memory card;

a card tray for mounting the memory card and moving back and forth inside the frame; and an inserting and ejecting means for fixing the card tray inside the frame and moving the card tray outwardly, wherein the card tray comprises a mounting surface for mounting the memory card thereon;

a plurality of terminal slots formed at the mounting surface for electrically contacting the plurality of connector terminals with the memory card; and an elastic lever for fixing the memory card on the mounting surface.

2. The connector of claim 1, wherein the elastic lever is installed at a side of the card tray and securely fixes the memory card inside the mounting surface by elastically pushing the memory card.

3. The connector of claim 1, wherein the inserting and ejecting means comprises:

an eject lever receiving a driving force from outside for ejecting the memory card;

an elastic member elastic-deformed by the eject lever and having a hole; and a protruding member formed on a side of the card tray in order to fix or release the card tray by respectively engaging or disengaging with the hole of the elastic member.

4. The connector of claim 1, wherein a prevention unit is installed at the inner side of the frame in order to guide moving of the card tray and prevent too much ejection of the card tray.

5. The connector of claim 1, wherein the plurality of connector terminals and a plurality of the frames are orderly laminated, and the laminated plurality of connector terminals and frames are combined by being inserted into a housing.

6. The connector of claim 5, wherein a plurality of protruding members are separately formed at the outer side surface of the frame, a plurality of holes are punched through the side surface of the housing, and the frame and the housing are combined by engaging the plurality of protruding members with the plurality of holes.

7. A connector for a memory card comprising:

a plurality of frames having a memory card insertion portion:

a plurality of connector terminals installed at a side of each frame for being connected to a memory card;

a card tray for mounting the memory card and moving back and forth inside each frame; and an inserting and ejecting means for fixing the card tray inside each frame and moving the card tray outwardly, wherein each card tray comprises:

a mounting surface for mounting the memory card thereon;

a plurality of terminal slots formed at the mounting surface for electrically contacting the plurality of connector terminals with the memory card; and an elastic member for fixing the memory card on the mounting surface.

8. The connector of claim 7, wherein the plurality of connector terminals and the plurality of frames are orderly stacked, and the stacked plurality of connector terminals and frames are combined by being inserted into a housing.

9. The connector of claim 7, wherein a plurality of protruding members are separately formed at outer side surfaces of each frame, a plurality of holes are punched through side surfaces of the housing, and each frame and the housing are combined by engaging the plurality of protruding members with the plurality of holes.

10. A memory card connector for an information apparatus comprising:

two frames having a memory card insertion portion;

a plurality of connector terminals installed at a side of each frame and being connected to a memory card;

a card tray for mounting the memory card and moving back and forth inside each frame; and inserting and ejecting means for installing the card tray inside the frame and moving the card tray outwardly, wherein the inserting and ejecting means comprises:

an eject lever receiving a driving force for ejecting the memory card from outside;

an eject spring elastic-deformed by the eject lever and having a bridging hole at a side thereof; and a bridging protrusion formed on a side of the card tray in order to fix the card tray at the memory card insertion portion of the frame by engaging with the bridging hole of the eject spring.

* * * * *